United States Patent [19]

Torigoe

[11] Patent Number: 4,645,697

[45] Date of Patent: Feb. 24, 1987

[54] TAPE FOR CORROSION PROTECTION

[75] Inventor: Yutaka Torigoe, Kumagaya, Japan

[73] Assignee: Dainichi-Nippon Cables, Ltd., Amagasaki, Japan

[21] Appl. No.: 793,424

[22] Filed: Oct. 31, 1985

[30] Foreign Application Priority Data

Oct. 31, 1984 [JP] Japan ..... 59-230924
Dec. 31, 1984 [JP] Japan ..... 59-279603
Dec. 31, 1984 [JP] Japan ..... 59-279604

[51] Int. Cl.[4] ..... B32B 3/16

[52] U.S. Cl. ..... 428/43; 428/56; 428/77; 428/344; 428/351; 428/354; 428/906; 138/DIG. 6; 138/103; 138/134

[58] Field of Search ..... 428/43, 55, 77, 344, 428/351, 906, 354, 56; 138/DIG. 6, 103, 134, 138/150; 174/108

[56] References Cited

U.S. PATENT DOCUMENTS 3,505,144 4/1970 Kilduff et al. ..... 428/344 X
3,990,478 11/1976 McFarland ..... 138/DIG. 6
4,499,136 2/1985 Nakamura et al. ..... 138/DIG. 6

*Primary Examiner*—Alexander S. Thomas
*Attorney, Agent, or Firm*—Armstrong, Nikaido, Marmelstein & Kubovcik

[57] ABSTRACT

A tape for corrosion protection, in which a pressure sensitive adhesive is coated on one face of a plastic sheet, and pieces of galvanic sacrificial anode metal foil for cathodic protection are lined consecutively on a part of its adhesive face across less than the entire width of the plastic sheet. An object of this invention is to prevent corrosion by means of an effect of cathodic protection.

12 Claims, 16 Drawing Figures

TAPE FOR CORROSION PROTECTION

FIELD OF THE INVENTION

This invention relates to a new tape for corrosion protection having an effect of cathodic protection.

DESCRIPTION OF THE PRIOR ART

Vinyl adhesive tapes for corrosion protection or polyethylene adhesive tapes for corrosion protection have been frequently used as materials for corrosion protection of various metals for such as piping, structure etc. used under corrosive environments such as in atmosphere, in sea water or in soil etc.

These tapes for corrosion protection are wound at the time of manufacturing metals or field construction. However, corrosion would occur due to incomplete taping of ingress of water from lap caused by a long term of use.

In order to improve a reliability on corrosion protection, such a step is taken to prevent the ingress of water that under coat or filler is coated when taping. However, this step requires a difficult work and increases an execution cost.

On the other hand, there exists the sacrificial anode system for an electrochemical protection of metal. The sacrificial anode system is a system which is intended for electrically connecting a metal having a low electrode potential and excellent galvanic characteristics such as magnesium, aluminum, zinc or their alloys (called as a galvanic sacrificial anode or a sacrificial anode) with a corrosion protected metal, and for protecting the metal from being corroded by a current flowed from the sacrificial anode to the metal. It is well known that a corrosion effect similar to the sacrificial anode system can be obtained from this principle when iron and steel products are coated with zinc coating or coated with zincrich paint.

By the way, a conventional tape for corrosion protection is a tape wherein pressure sensitive adhesive is applied on an elastic plastic sheet such as polyethylene, polyvinyl chloride etc., and which has a low permeability of vapor and a low absorption of water so that permeability of vapor or water from the sheet surface is extremely small as compared with that from the lap. Accordingly, it is enough to prevent the ingress of water from the lap of tape for corrosion protection in order to control the corrosion. However, it is hardly possible to carry this protection through from the standpoint of construction of tape.

Here, if the electrochemical protection can control the corrosion even when water enters from the lap of tape for corrosion protection, it will suit our convenience.

SUMMARY OF THE INVENTION 1. (Object of the Invention)

An object of this invention is to provide a tape for corrosion protection which can control an occurence of corrosion thanks to an effect of cathodic protection even when water enters a corrosion protected metal from a lap or a sheet surface of the tape for corrosion protection, and to provide a method for manufacturing a tape for corrosion protection on a part of adhesive face of which a metal foil of galvanic sacrificial anode for cathodic protection is consecutively lined in a form of piece, and which has said effect.

2. (Composition of the Invention)

A first invention comprises a tape for corrosion protection, in which pressure sensitive adhesive is applied on one face of a plastic sheet and a piece of metal foil of galvanic sacrificial anode for cathodic protection is consecutively lined on a part of its adhesive face. Further, a second invention comprises a method for manufacturing the tape for corrosion protection comprising three processes: a first process in which the pressure sensitive adhesive is applied on one face of a long and narrow continuous plastic sheet, a second process in which ditches are cut on one face or both faces of the long and narrow continuous metal foil of galvanic sacrificial anode for cathodic protection on every specified distance, and a third process in which said long and narrow metal foil is consecutively lined on a part of the adhesive face of said plastic sheet.

DETAILED DESCRIPTION OF THE INVENTION (Explanation of the Tape for Corrosion Protection: 1)

Figure 1:
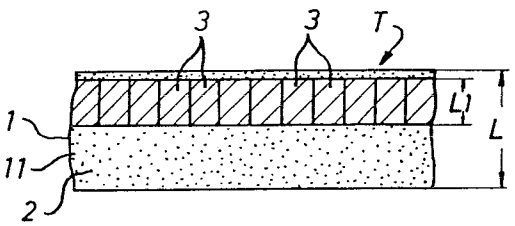
FIG. 1 is an explanatory drawing showing one embodiment of a tape for corrosion protection according to this invention.

FIG. 1 shows an embodiment of the tape for corrosion protection according to the present invention. In FIG. 1, 1 is a long plastic sheet made of polyethylene, polyvinyl chloride etc. and having a proper elasticity. 2 is a pressure sensitive adhesive applied on one face 11 of said sheet 1. A usual adhesive vinyl tape for corrosion protection may also be used for these sheet 1 and pressure sensitive adhesive 2. 3 are plural pieces of metal foil for corrosion protection comprising a metal foil of galvanic sacrificial anode for cathodic protection composed of zinc, aluminum, magnesium etc. This metal foil piece 3 is formed into a rectangular shape, sized in its width $L_1$ as just half or less as a width L of said sheet 1, and consecutively lined on the adhesive face 11 of the sheet 1 in a direction along tape line. Although details being not shown, it is preferable to previously mold and round four corners of each piece 3 in order to prevent an intrusion of the piece in the sheet at the time of winding the tape described later.

Figure 2:
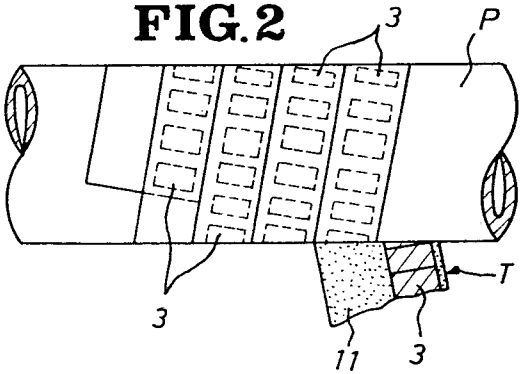
FIG. 2 is an explanatory drawing of a used state of the tape for corrosion protection shown in FIG. 1.

The tape for corrosion protection T according to this invention comprising as above is especially suitable for executing a taping of ½ lap in outer peripheral direction along tape line of a corrosion protected metal (for example, metal pipe P), as shown in FIG. 2, with the adhesive face 11 i.e. the lining face of the metal foil piece 3 directed toward the pipe P side. Namely, when lapping is done by permitting a side on which the metal foil piece for corrosion protection 3 is lined go ahead, the piece 3 can be lined uniformly in the outer peripheral direction along tape line of the pipe P. Further, the side on which the piece 3 is not lined has an effect of surface pressure so that the same effect as the conventional tape for corrosion protection can be secured against the ingress of water.

Figure 3:
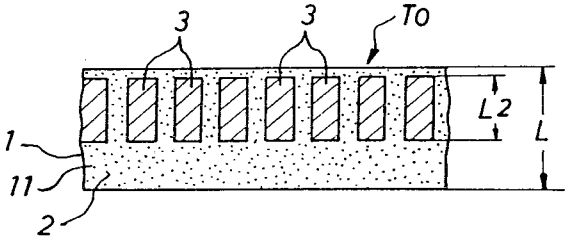
FIG. 3 is an explanatory drawing showing another embodiment of the tape for corrosion protection according to this invention.

FIG. 3 shows another embodiment of the tape for corrosion protection. As shown in FIG. 3, the tape for corrosion protection $T_o$ has a construction that a width $L_2$ of the metal foil piece for corrosion protection 3 lined on the adhesive face 11 of the sheet 1 is sized about two thirds or less of the width L. Incidentally, a base material shown in FIG. 3 having the same symbol as FIG. 1 indicates the same base material as FIG. 1.

Figure 4:
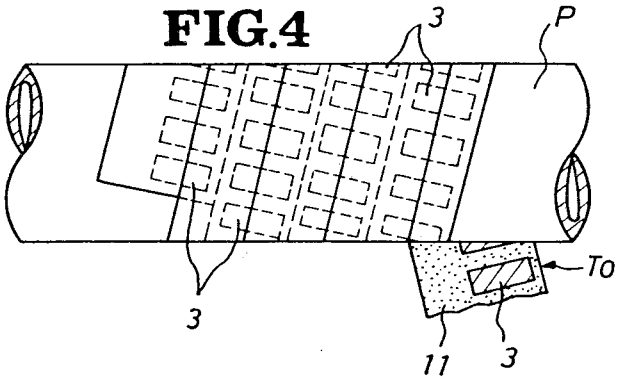
FIG. 4 is an explanatory drawing showing a used state of the tape for corrosion protection shown in FIG. 3.

This tape for corrosion protection $T_o$ is especially suitable for executing a taping of ⅓ lap in the outer peripheral direction along tape line of the corrosion protected metal, for example: the metal pipe P such as steel pipe etc., as shown in FIG. 4.

In the above description the metal foil pieces for corrosion protection 3 may be formed not only into the rectangular shape as shown in FIGS. 1 and 3, but also into a round shape, an oval shape or a rhombic shape. Further, they may be disposed close each other as shown in FIG. 1 or disposed with specified spaces left therebetween.

Construction and embodiment of the tape for corrosion protection according to the present invention have been described and preferable examples of specifications thereof are tabulated in Table 1. Incidentally, a thickness of the metal foil is preferably about 0.08 mm~0.1 mm.

It goes without saying that the corrosion protection effect of the tape for corrosion protection according to the present invention is the same as that of the conventional tape for corrosion protection unless the ingress of water occurs. A cathodic protection effect in the event of the ingress of water is determined by the effective voltage and total amount of electricity for corrosion protection metal foil as tabulated in Table 2 and Table 3.

TABLE 1

Examples of specifications of tape for corrosion protection

| | Example 1 | Example 2 |
|---|---|---|
| Sheet material | Low density polyethylene | Plasticized polyvinyl chloride |
| Sheet thickness (mm) | 0.25 | 0.27 |

TABLE 1-continued

Examples of specifications of tape for corrosion protection

| | Example 1 | Example 2 |
|---|---|---|
| Sheet width (mm) | 51 | 50 |
| Pressure sensitive adhesive | Pressure sensitive adhesive of synthetic rubber group | Pressure sensitive adhesive of synthetic rubber group |
| Adhesive thickness (mm) | 0.1 | 0.13 |
| Metal foil | Zinc alloy | Zinc alloy |
| Metal foil thickness (mm) | 0.1 | 0.1 |
| Metal foil size (mm) | 20 × 10 | 20 × 10 |
| Length of one reel (m) | 30 | 10 |

TABLE 2

Effective voltage and total amount of electricity for corrosion protection metal foil

| Kind of metal | Zinc alloy | Aluminum alloy | Magnesium alloy |
|---|---|---|---|
| Effective voltage in relation to iron (V) | 0.2 | 0.25 | 0.75 |
| Specific gravity | 7.14 | 2.83 | 1.74 |
| Theoretical total amount of electricity (Ah/g) | 0.82 | 2.87 | 2.20 |
| Weight of 0.1 mm thick foil (g/cm$^2$) | 0.071 | 0.028 | 0.017 |
| Theoretical total amount of electricity for 0.1 mm thick foil (Ah/cm$^2$) | 0.06 | 0.08 | 0.04 |

TABLE 3

Effective voltage and total amount of electricity for corrosion protection metal foil

| Kind of metal | Zinc alloy | Aluminum alloy | Magnesium alloy |
|---|---|---|---|
| Effective voltage in relation to iron (V) | 0.20 | 0.25 | 0.75 |
| Specific gravity | 7.14 | 2.83 | 1.74 |
| Theoretical total amount of electricity (Ah/g) | 0.82 | 2.87 | 2.20 |
| Weight of 0.08 mm thick foil (g/cm$^2$) | 0.057 | 0.022 | 0.014 |
| Theoretical total amount of electricity for 0.08 mm thick foil (Ah/cm$^2$) | 0.047 | 0.063 | 0.031 |

As seen from Table 2 and Table 3, when an effective voltage and a total amount of electricity for corrosion protection metal foil are compared with others, there are differences between the zinc group, the aluminum group and the magnesium group. However, in case when this tape for corrosion protection is applied to iron and steel products, the zinc group or the aluminum group is enough for that purpose. Incidentally, when the zinc coating is applied on iron and steel products to protect them from corrosion, it is generally said that a sticking amount of zinc coating per unit area is preferably 0.06 g/cm$^2$ or more for a galvanized steel pipe for water service.

In case when a 0.08 mm thick zinc alloy is lined on the tape for corrosion protection as the corrosion protection metal foil for use in a steel pipe with no zinc coating thereon, its weight is 0.057 g/cm$^2$ as seen from Table 3. Therefore, its total sticking amount becomes approximately equivalent to that of the zinc coating. As explained above, the effect of cathodic protection borne by the zinc coating can be added in addition to the corrosion protection effect peculiar to the tape for corrosion protection, so that its reliability on the corrosion protection can be improved remarkably.

The following effects may be expected according to said tape for corrosion protection:

(1) Protection effect: The protection effect can be improved owing to overlapped effects of the corrosion protection similar to the conventional tape caused by the sheet itself and the electrochemical protection caused by the corrosion protection metal foil. Further, since each piece of the foil is separated each other when used, current from sacrificial anode can be dispersed and local concentration of current can be avoided. Consequently, an early corrosion of a corrosion protected metal due to local wear and tear of the metal foil for corrosion protection can be prevented.

(2) Protection life: The sheet minimizes wear and tear of the corrosion protection metal to heighten its protection life.

(3) Quantity of corrosion protection metal: A quantity of the protection metal required for corrosion protection becomes small as compared with the conventional one.

(4) Taping ability: Owing to the small size of protection metal foil, occurence of puckering and disturbance of lap can be avoided at the time of taping.

(5) Surface pressure: The surface pressure between the metal and the tape can be heightened by the elasticity of tape for corrosion protection, so that electrical contact between the metal and the protection metal foil is improved.

(6) Profitability: The longer protection life will save the cost of tape on the assumption that the tape prices are the same.

(Explanation of tape for corrosion protection: 2)

Figure 5:
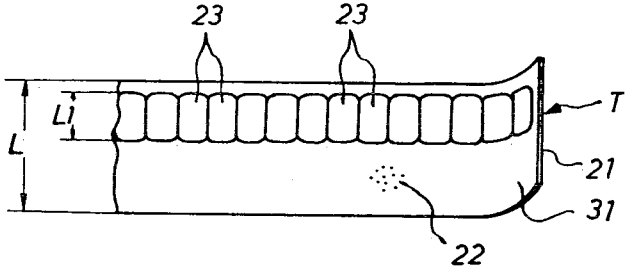
FIG. 5 is a plan view showing further another embodiment of the tape for corrosion protection according to this invention.

FIG. 5 shows further another embodiment of the tape for corrosion protection according to the present invention. In FIG. 5, 21 is a transparent or semi-transparent long plastic sheet made of polyethylene, polyvinyl chloride etc., and has an elasticity. 22 is a pressure sensitive adhesive applied on one face 31 of said sheet 21, and an usual transparent or semi-transparent adhesive is used for that adhesive. 23 are plural pieces of metal foil for corrosion protection comprising said protection metal foil. This metal foil piece 23 is formed into an oval shape, sized in its width $L_1$ as just half or less as a width L of said sheet 21, and consecutively lined on the adhesive face 31 of the sheet 21 in a direction along tape line.

Figure 6:
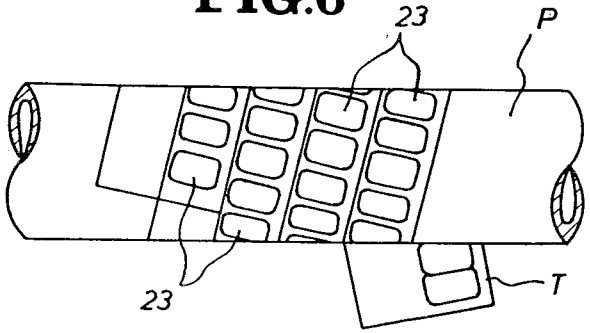
FIG. 6 is a side view of a used state of the tape for corrosion protection of FIG. 5.

The tape for corrosion protection T according to this invention comprising as above is especially suitable for executing a taping of $\frac{1}{2}$ lap in outer peripheral direction along tape line of a corrosion protection metal (for example, metal pipe P) as shown in FIG. 6, with the adhesive face 31 i.e. the lining face of the metal foil piece 23 directed toward the pipe P side. In this case, since the sheet 21 is transparent or semi-transparent, the metal foil piece for corrosion protection 23 lined inside the sheet can be viewed from above said sheet 21. Consequently, it can be easily ensured whether or not said metal foil pieces for corrosion protection 23 are uniformly lined on the outer periphery of the pipe P. Thereby, the taping work can be carried out easily and a highly reliable corrosion protection taping becomes possible.

Figure 7:
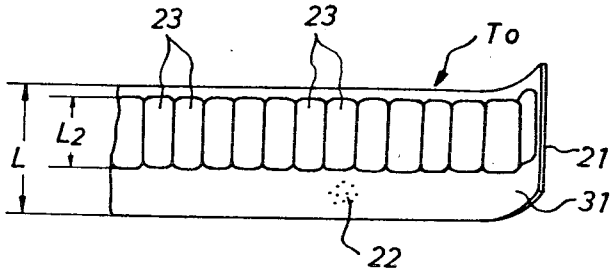
FIG. 7 is a plan view showing further another embodiment of the tape for corrosion protection according to this invention.
Figure 8:
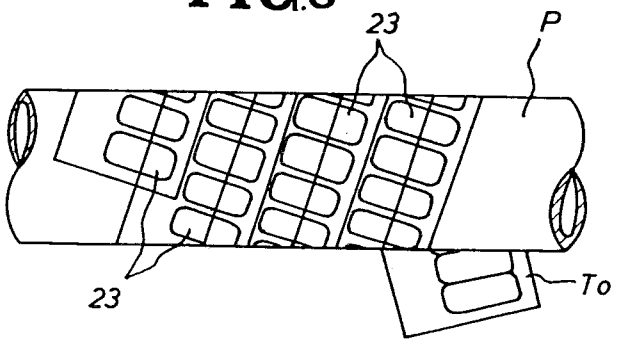
FIG. 8 is a side view showing a used state of the tape for corrosion protection shown in FIG. 7.

Also in this case, such a construction may be employed that a width of the metal foil for corrosion protection 23 lined on the adhesive face 31 of the sheet 21 of the tape for corrosion protection $T_o$ is sized about two thirds or less of the width L, as shown in FIG. 7. This tape for corrosion protection $T_o$ is especially suitable for executing a taping of $\frac{1}{3}$ lap in the outer peripheral direction along tape line of the corrosion protected metal i.e. the metal pipe P as shown in FIG. 8.

In the above description, the metal foil piece for corrosion protection 23 can be modified in the same manner as the pieces 3 of FIG. 1 and FIG. 3. Incidentally, since no projection such as corner etc. exists when pieces formed into oval and circular shapes are used, an intrusion of projection into the sheet 21 can be advantageously avoided at the time of taping.

Construction and embodiment of the tape for corrosion protection according to the present invention have been described and preferable examples of specifications thereof are the same as Table 1. Provided that, in this embodiment, transparent or semi-transparent low-density polyethylene and transparent or semi-transparent plasticized polyvinyl chloride are used for the base material.

The tape for corrosion protection according to the present invention has the construction as described above, and has the same function as the tape for corrosion protection of FIGS. 1 and 3. Especially, the sheet for use in the base meterial of tape is made transparent or semi-transparent in the tape for corrosion protection of this embodiment, so that the metal foil piece for corrosion protection lined inside the sheet at the time of taping can be viewed from outside through the sheet, and it can be easily ensured whether or not said metal foil pieces for corrosion protection are uniformly lined. Consequently, the taping work can be carried out easily and quickly and a highly reliable corrosion protection taping becomes possible, so that its industrial value is tremendous.

(Explanation of tape for corrosion protection: 3)

Figure 9:
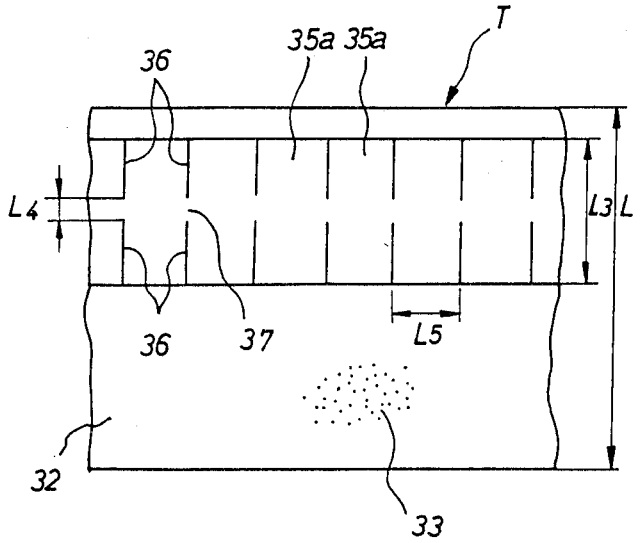
FIGS. 9 and 10 are plan views showing further another embodiments respectively.
Figure 10:
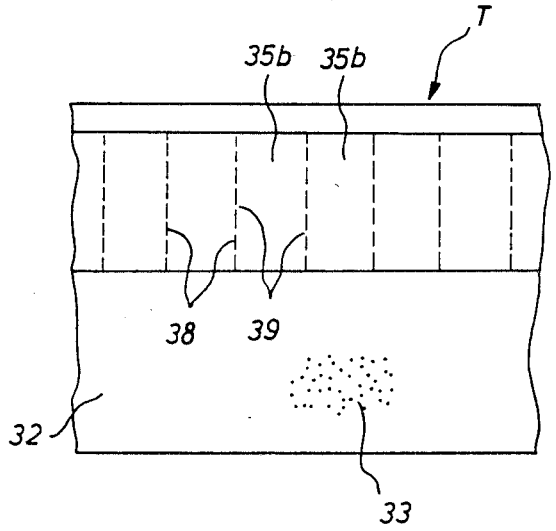

FIG. 9 and FIG. 10 show further embodiments of the tape for corrosion protection, respectively. In FIG. 9 and FIG. 10, 32 is a plastic sheet similar to said plastic sheet and has an elasticity. 33 is a pressure sensitive adhesive applied on a sheet 32 and similar to said pressure sensitive adhesive.

35*a* of FIG. 9 are plural metal foil pieces for corrosion protection comprising said metal foil for corrosion protection, and in this case ditches 36 are formed between the metal foil pieces 35*a* in a direction of width of the metal foil. These ditches 36 extend from both width side ends of the metal foil toward its center and a joining portion 37 which can be easily broken is left between tip ends of them. Namely, the before-use metal foil pieces 35*a* of the tape for corrosion protection T are joined by the joining portions 37 lengthwise in the direction along tape.

35*b* of FIG. 10 are plural metal foil pieces for corrosion protection comprising said metal foil for corrosion protection, and in this case dashed-line ditches 38 are formed between the metal foil pieces 35*b* in a direction of width of the metal foil. Easily breakable joining portions 39 are formed in parts left by the dashed-line ditches 38, and the before-use metal foil pieces 35*b* of the tape for corrosion protection T are joined by the joining portions 39 lengthwise in the direction along tape.

The tapes for corrosion protection of FIG. 9 and FIG. 10 are wound around the pipe etc. while being tensed in the same manner as said embodiment. In this instance, the tape T elongates in the longitudinal direction due to the elasticity of the sheet 32. Thereby, the joining portions 37 and 39 are broken, the metal foil pieces 35*a* and 35*b* are separated independently each other to become the same states as FIG. 2 and FIG. 4.

Incidentally, also in this embodiment, four corners of the metal foil pieces 35*a* and 35*b* may be rounded in the same manner as said embodiment.

In a preferred example of metal foil, when a width L of the plasticized polyvinyl chloride sheet 32 of FIG. 9 is 50 mm and its thickness is 0.40 mm, a zinc foil having sizes of 27 mm in its width $L_3$ and 0.08 mm in its thickness is used for the metal foil 35*a*, and a width $L_4$ of the joining portion 37 is set to 0.8~1.2 mm. A length $L_5$ in the longitudinal direction of the metal foil 35*a* is set to 8~16 mm, preferably about 12 mm. The inventor ensured by experiments that, in order to wind the tape for corrosion protection T having such specifications (provided that $L_4=1.0$ mm, $L_5=12$ mm) around a corrosion protected metal pipe under a condition where its elongation becomes 10% at a measured temperature of 25° C., a taping tension of 6.2 kg was required and in this case the joining portion 37 was easily broken to produce a clearance of about 1.5 mm between metal foil pieces 35*a* and 35*a*.

(Explanation of manufacturing method)

Figure 11:
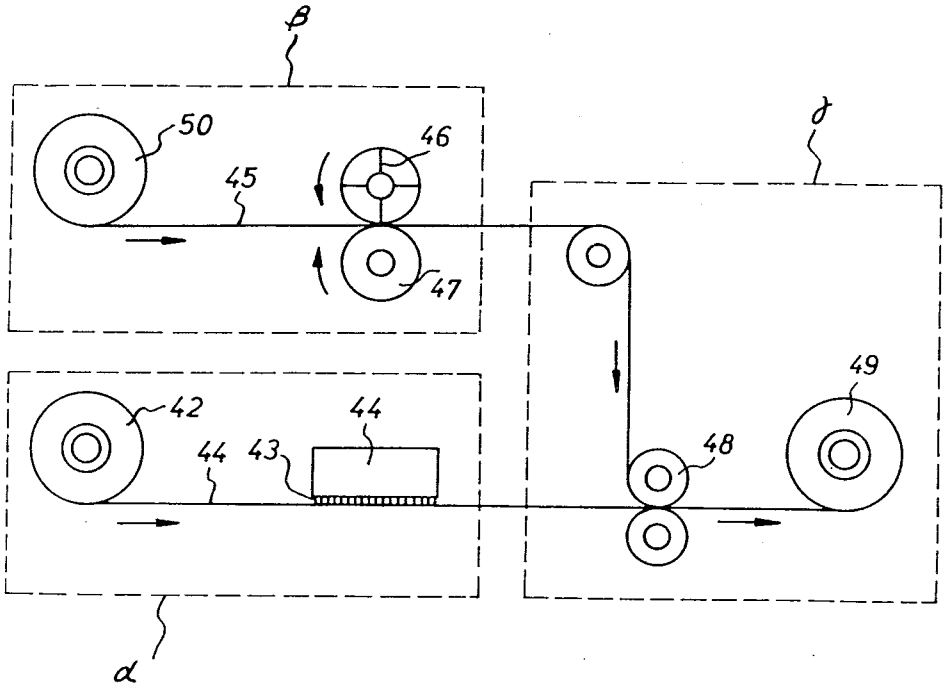
FIG. 11 is a manufacture process diagram showing one embodiment of a method for manufacturing the tape for corrosion protection according to this invention.

FIG. 11 shows an embodiment of manufacturing method for the tape for corrosion protection according to the present invention. In FIG. 11, $\alpha$ indicates a first process in which a sheet 41 similar to said sheets 1 & 21 is rewound from a working bobbin 42 and a pressure sensitive adhesive 43 is coated on one face of said sheet 41 by means of a coating equipment. An usual vinyl adhesive tape for corrosion protection may be used for these sheet 41 and pressure sensitive adhesive 43.

$\beta$ shows a second process in which a metal foil for corrosion protection 45 having the same material as said metal foil for corrosion protection 3 is rewound from a working bobbin 50 and ditches are cut on one face or both faces of said metal foil 45 up to an easily breakable depth on every prescribed distance. In this second process, it is recommended to cut each end of ditch into V-shape simultaneously with cutting of ditch. Incidentally, a width of said metal foil 45 is preferably smaller than the width of said plastic sheet 41 and is generally in a range from one to two thirds of the width of sheet 1.

Figure 12A:
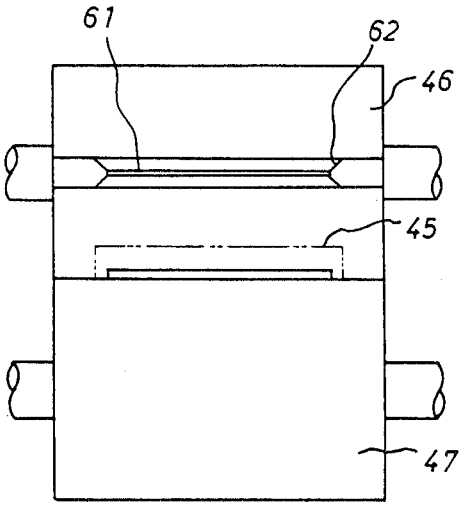
FIGS. 12 A, B and C are a front view, a plan view and a side view showing an outline of a ditch forming device for use in the second process of this invention respectively.
Figure 12C:
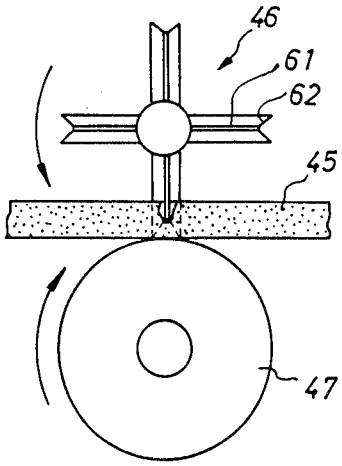
Figure 12B:
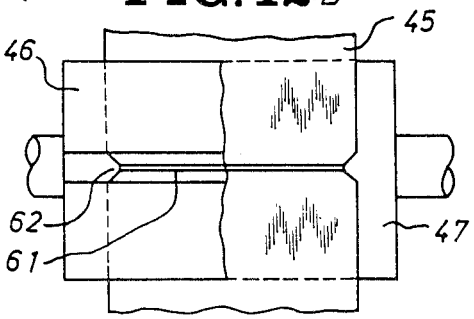
Figure 13:
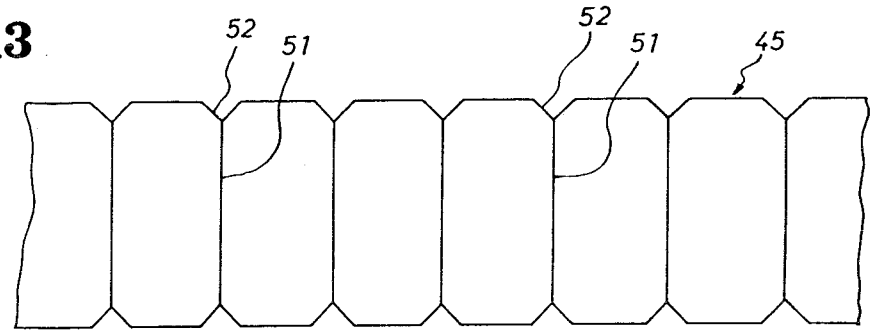
FIG. 13 is a plan view showing a metal foil for corrosion protection formed in the second process.

An outline of equipment, which cuts ditches in the metal foil for corrosion protection 45 or cuts them into V-shape in the second process, is shown in FIGS. 12 A, B and C. In FIGS. 12 A, B and C, a ditch edge 61 attached to a rolling cutter 46 is an edge for cutting a ditch lengthwise on one face of the metal foil for corrosion protection 45 on every prescribed distance, and a cut edge 62 provided together with said ditch 61 is an edge for cutting the tape into V-shape. In FIGS. 12 A, B and C, 47 shows a support roller. A shape of the metal foil for corrosion protection 45 worked by this equipment is shown in FIG. 13. In FIG. 13, 51 is a ditch and 52 is a cut part of V-shape.

As object of cutting the ditch 51 in the metal foil for corrosion protection 45 up to the easily breakable depth on every prescribed distance is to permit the metal foil for corrosion protection 45 to be broken by means of the elongation of the tape (plastic sheet 41) and to enable its piece 45*a* adhere close to the corrosion protected metal, at the time when the tape for corrosion protection is lined to or wound around the corrosion protected metal (for example, metal pipe) with a specified tension given thereto. Further, an object of cutting the V-shape 52 in each end of the ditch 51 of the metal foil for corrosion protection 45 is to provide an easy breakage of the metal foil for corrosion protection 45 and at the same time to prevent the four corners of the piece 45*a* from intruding into the sheet at the time when the tape for corrosion protection is lined or wound. Accordingly, the cut shape of the metal foil for corrosion protection 45 is preferably a rounded V-shape, that is: Y-shape.

Figure 14:
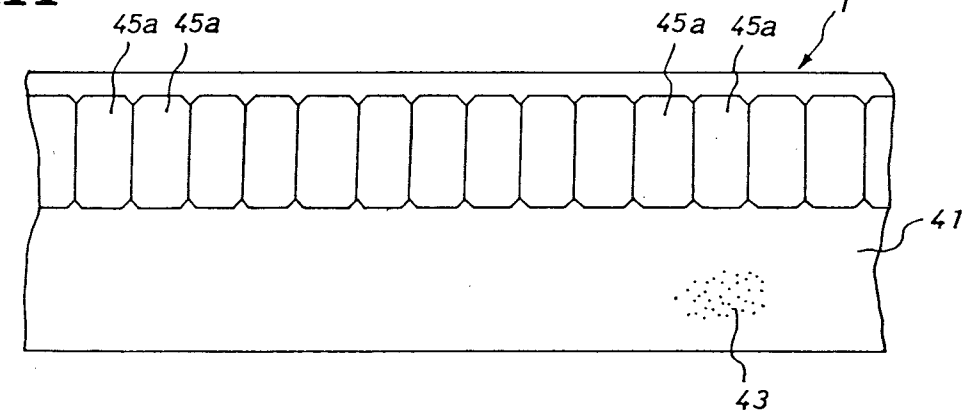
FIG. 14 is a plan view showing the tape for corrosion protection obtained by the manufacturing method according to the present invention.

$\gamma$ in FIG. 11 shows a third process in which the metal foil for corrosion protection 45 obtained by the second process is lined consecutively on a part of an adhesive face of the long plastic sheet obtained in the first process by a pair of pressing rolls 48, and the sheet is wound around a finished goods bobbin 49. A development of the tape for corrosion protection T manufactured in the above process is shown in FIG. 14. In FIG. 14, the reason why the metal foil for corrosion protection 41 is lined on one lateral side of the plastic sheet 41 is that a margin for lapping suitable for the $\frac{1}{2}$ lap or $\frac{1}{3}$ lap is to be left as described above when the taping of tape for corrosion protection is carried out on the corrosion protected metal plate or corrosion protected metal pipe.

Incidentally, it goes without saying that the tapes for corrosion protection T shown in FIGS. 9 and 10 can also be manufactured in the same way by changing a shape of the edge 61.

(Effect of the Invention)

The tape for corrosion protection according to the present invention shows the same protection effect as the conventional tape for corrosion protection because of the close tightness and adhesive property of the tape. Further, even if water intrudes in the corrosion protected metal, the protection effect of tape can be maintained continuously by the protection effect of the galvanic sacrificial anode metal foil for cathodic protection. Moreover, the taping work is quite the same as that of the conventional tape for corrosion protection so that no special technique is required.

Namely, the tape for corrosion protection according to the present invention can advantageously improve the reliability on the corrosion protection by a large margin without any taping technique thanks to its water tightness and overlapped effects.

According to the manufacturing method of this invention, it becomes easy to enhance a production of taping and to control its quality by continuously lining the metal foils for corrosion protection on the plastic sheet without dividing it into pieces. Further, since the metal foil for corrosion protection is properly separated into pieces to be adhered to the corrosion protected metal owing to the elasticity of tape when executing the taping work of the tape for corrosion protection, the laps of the tape for corrosion protection also become well adhered each other and the ingress of water can be extremely minimized.

What is claimed is:

1. A tape for corrosion protection, in which a pressure sensitive adhesive is coated on one face of a plastic sheet, and pieces of galvanic sacrificial anode metal foil for cathodic protection are lined consecutively on a part of its adhesive face, a width of said metal foil being less than a width of said plastic sheet.

2. A tape for corrosion protection as set forth in claim 1, in which said plastic sheet is transparent or semi-transparent.

3. A tape for corrosion protection as set forth in claim 1, in which said plastic sheet comprises synthetic resin having an elasticity.

4. A tape for corrosion protection as set forth in claim 1, in which said pieces of metal foil are separated independently of each other.

5. A tape for corrosion protection as set forth in claim 1, in which said pieces of metal foil prior to use are joined through easily breakable ditches.

6. A tape for corrosion protection as set forth in claim 5, in which said ditches are composed of grooves in a direction of metal foil thickness.

7. A tape for corrosion protection as set forth in claim 5, in which said ditches are formed in a direction of the metal foil width.

8. A tape for corrosion protection as set forth in claim 7, in which said ditches extend from both width ends of the metal foil toward its center.

9. A tape for corrosion protection as set forth in claim 7, in which said ditches are formed into a dashed-line shape in the direction of metal foil width.

10. A tape for corrosion protection as set forth in claim 1, in which said metal foil is formed into a rectangular shape four corners of which are rounded.

11. A tape for corrosion protection as set forth in claim 1, in which said metal foil is formed into an oval shape.

12. A tape for corrosion protection as set for forth in claim 1, in which the width of said metal foil is two thirds or less of the width of said plastic sheet.

* * * * *